US009533743B2

(12) United States Patent
Cox

(10) Patent No.: US 9,533,743 B2
(45) Date of Patent: Jan. 3, 2017

(54) LIFE SAVING APPARATUS

(71) Applicant: Terry W. Cox, South Meriden, CT (US)

(72) Inventor: Terry W. Cox, South Meriden, CT (US)

( * ) Notice: Subject to any disclaimer, the term of this patent is extended or adjusted under 35 U.S.C. 154(b) by 0 days.

(21) Appl. No.: 14/212,541

(22) Filed: Mar. 14, 2014

(65) Prior Publication Data

US 2014/0285322 A1 Sep. 25, 2014

Related U.S. Application Data

(60) Provisional application No. 61/791,190, filed on Mar. 15, 2013.

(51) Int. Cl.

| | |
|---|---|
| ***G08B 21/02*** | (2006.01) |
| ***B63C 9/00*** | (2006.01) |
| ***G08B 21/08*** | (2006.01) |
| ***B63C 9/13*** | (2006.01) |

(52) U.S. Cl.

CPC ..... *B63C 9/0005* (2013.01); *B63C 9/13* (2013.01); *G08B 21/088* (2013.01); *B63C 2009/0017* (2013.01)

(58) Field of Classification Search

CPC ..... G08B 21/18; G08B 1/08

See application file for complete search history.

(56) References Cited

U.S. PATENT DOCUMENTS

| | | | | |
|---|---|---|---|---|
| 6,028,513 | A * | 2/2000 | Addy | G08B 25/016 340/12.52 |
| 6,154,140 | A * | 11/2000 | Thorpe | B63C 11/02 340/573.6 |
| 2008/0266121 | A1* | 10/2008 | Ellul | G08B 7/066 340/584 |
| 2009/0295566 | A1* | 12/2009 | Weintraub | G08B 21/088 340/539.11 |
| 2010/0164712 | A1* | 7/2010 | Corrigan | G08B 13/1481 340/539.13 |
| 2010/0267361 | A1* | 10/2010 | Sullivan | G01S 19/17 455/404.2 |

* cited by examiner

*Primary Examiner* — Joseph Feild
*Assistant Examiner* — Pameshanand Mahase
(74) *Attorney, Agent, or Firm* — Rashauna Norment

(57) ABSTRACT

A life saving apparatus is presented. The apparatus activates an alarm and/or a notification when a person is in distress such as when a swimmer is drowning. In one embodiment, the alarm or notification may include an audio, a visual and/or combination thereof signal or indication that the person is in distress. The alarm or notification may be provided on a device held or attached to the person, at a base station in proximity to the person, or a combination thereof. In one embodiment, a locator provides an ability to identify the person in distress when that person is located in proximity to other persons so that aid can be given as quickly as possible.

19 Claims, 5 Drawing Sheets

LIFE SAVING APPARATUS

CROSS REFERENCE TO RELATED APPLICATIONS

This patent application claims priority benefit under 35 U.S.C. §119(e) of, commonly owned U.S. Provisional Patent Application Ser. No. 61/791,190, filed on Mar. 15, 2013, the disclosure of which is incorporated by reference herein in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the United States Patent and Trademark Office files or records, but otherwise reserves all copyright rights whatsoever.

TECHNICAL FIELD

The present invention relates generally to a life saving apparatus and, more particularly, to a system and method for activating an alarm and/or providing a notification when a person is in distress such as, for example, when the person, such as a swimmer, is engaged in an activity, namely, is swimming, and is in distress, namely, is drowning. In one embodiment, the alarm or notification may include an audio signal, a visual signal and/or a combination thereof provided to third parties that the person is in distress. The alarm or notification may be provided on a device held or attached to the person, provided at a base station located in proximity to the person engaged in the activity, or a combination thereof. In one embodiment, a locator provides an ability for the third parties to identify the person in distress when that person is located in proximity to other persons so that aid can be given as quickly as possible to the person in distress.

BACKGROUND OF THE INVENTION

Generally speaking, when a person is engaged in an activity and is in distress, the person is unable to call for assistance. For example, in many instances when a person that is swimming is in distress and is drowning, the person is unable to yell for help. Moreover, signs of distress such as when a swimmer splashes or is observed waving or flailing their arms, can be misunderstood. Often, when the swimmer is a young adult or child, the swimmer in distress is believed to be playing or acting. Very often persons that are in proximity to the swimmer in distress do not recognize the severity of the situation until it is too late and the swimmer has spent a period of time below water and/or suffered some type of harm.

In view of the foregoing, the inventor has recognized that there is a need for a device that can be activated by the person in distress to notify third parties in proximity to the person in distress that the person is in jeopardy and is in need of assistance.

DETAILED DESCRIPTION

Figure 1:
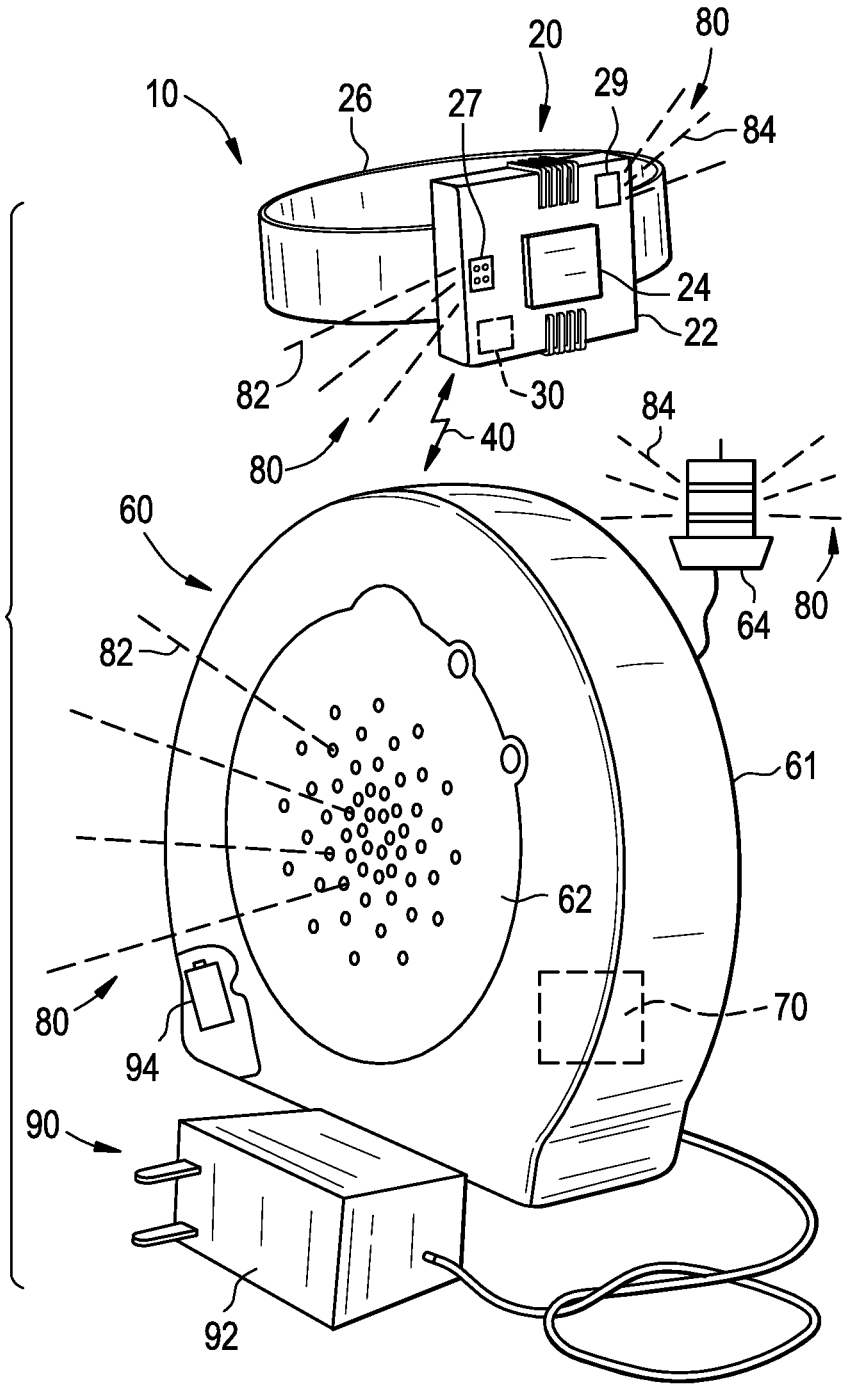
FIG. 1 is a schematic diagram of a life saving apparatus, in accordance with one embodiment of the present invention.

The present invention is directed to a life saving apparatus and, in particular, to a system and method for activating an alarm signal and/or providing a notification signal to third parties when a person is in distress. In one embodiment, the life saving apparatus provides what is referred to as a SWIMMER'S ALERT SYSTEM™ (SAS). The Swimmer's Alert System provides notification to third parties when a swimmer is in distress. Swimmer's Alert System is a trademark of Terry W. Cox, South Meriden, Conn. USA. In one embodiment, the alarm or notification may include an audio signal, a visual signal and/or a combination thereof, to third parties that the person is in distress. The alarm or notification may be provided on a device held or attached to the person in distress, provided at a base station located in proximity to the person, or a combination thereof. In one embodiment, a locator provides third parties with an ability to identify the person in distress when that person is located in proximity to other persons so that aid can be given as quickly as possible to the person in distress.

As shown in FIGS. 1-7, in one embodiment a life saving apparatus 10 of the present invention includes an activator 20 held or worn by a person such as, for example, on a wrist, arm or ankle band or wrap 26 worn by a person performing an activity. The activator 20 includes a switch or button 24 that activates circuitry 30 in a housing 22 of the activator 20 to activate an alarm or notification and/or to transmit a signal 40 to a base or receiving station 60 within proximity to the activator 20. The base station 60 receives and processes the signal 40 with circuitry 70 installed within a housing 61 of the base station 60. For example, the circuitry 70 processes the signal 40 and, in response thereto, generates an alarm or notification 80. In one embodiment, the alarm or notification 80 includes an audio signal or indication 82 such as, for example, a horn, beep or other audio transmission from a speaker system 62 installed at the base station 60 and/or a speaker system 27 installed within the activator 20. In one embodiment, the alarm or notification 80 includes a visual signal or indication 84 such as, for example, a flashing or blinking light or other visual transmission from a lighting system 64 installed at the base station 60 and/or a lighting system 29 installed within the activator 20.

Figure 2:
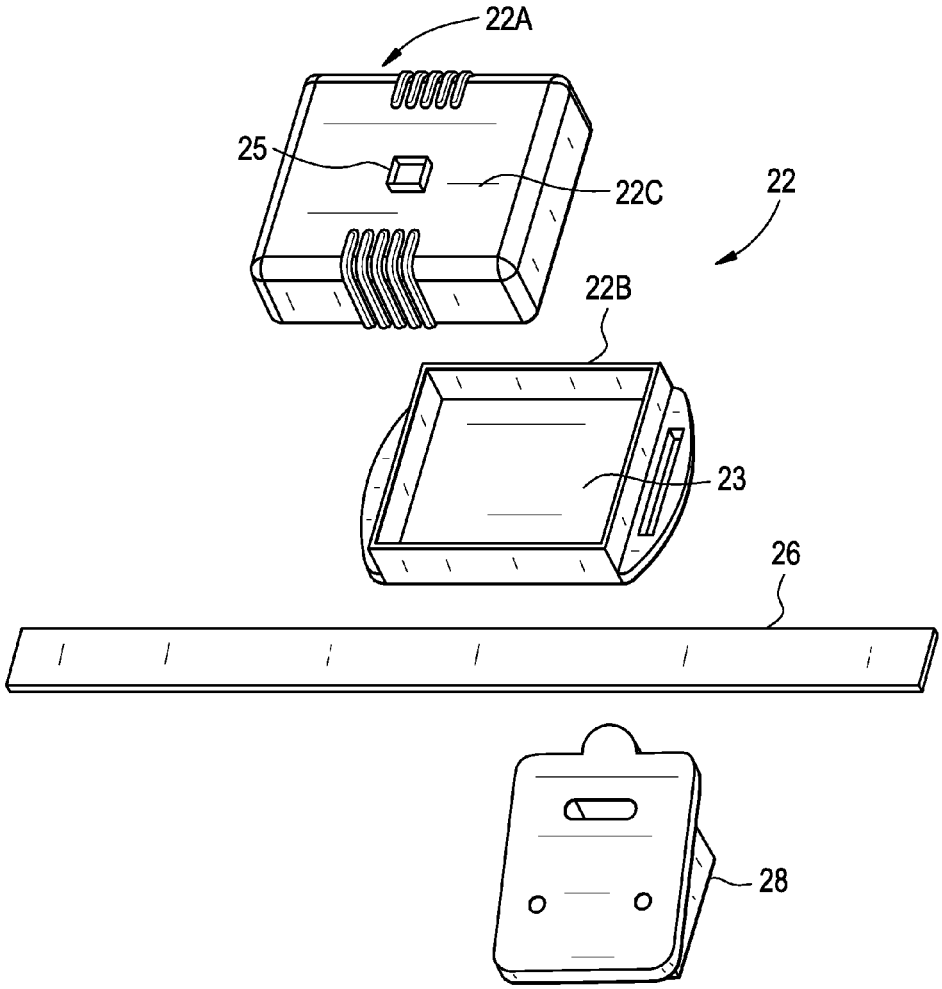
FIG. 2 is a schematic diagram of an activator of the life saving apparatus of FIG. 1, in accordance with one embodiment of the present invention.
Figure 3:
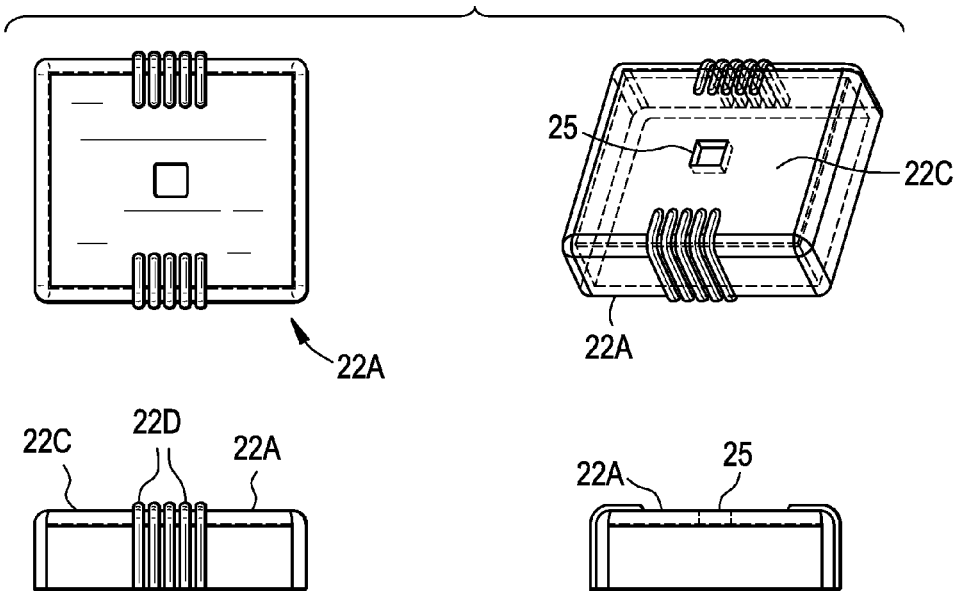
FIGS. 3-6 are schematic diagrams of a housing and a band for the activator of FIG. 2.
Figure 4:
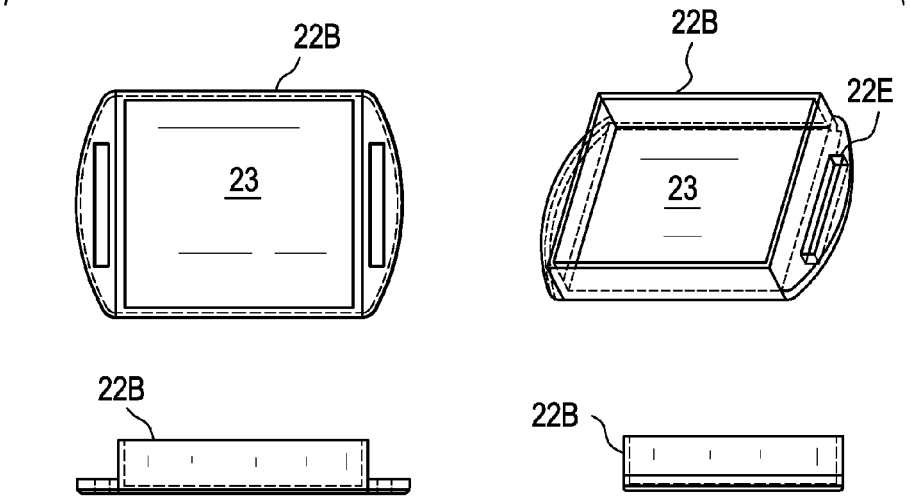
Figure 5:
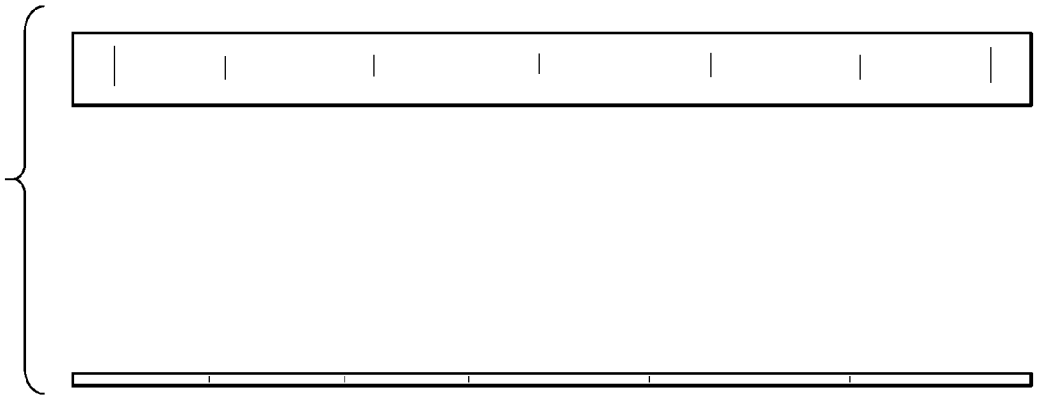
Figure 6:
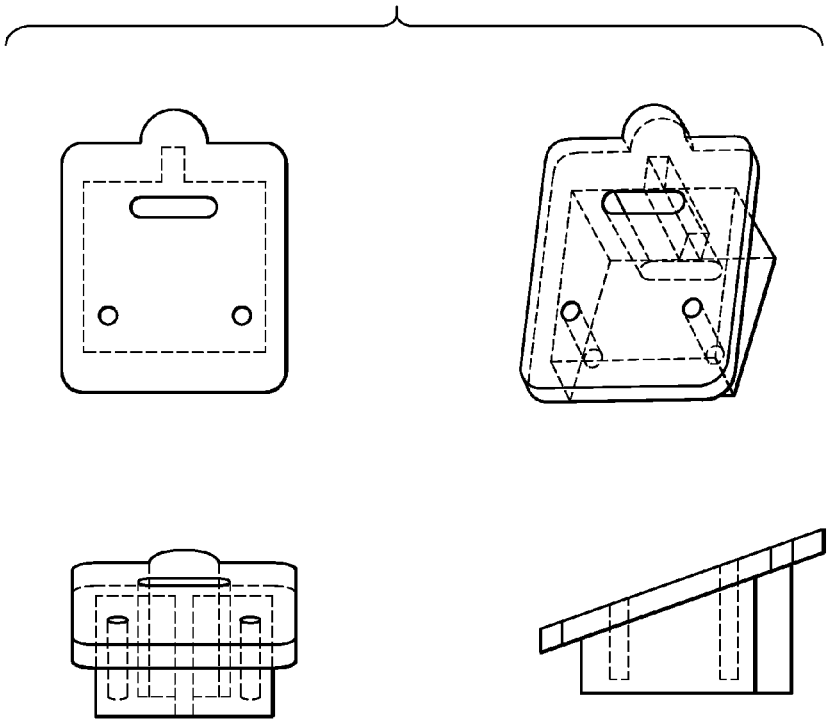

As described above, the activator 20 includes the housing 22. In one embodiment, as shown in FIG. 2, the housing 22 includes a first or upper portion 22A and a second or lower portion 22B. The lower portion 22B defines an internal cavity or chamber 23 that houses the circuitry 30 of the activator 20. The upper portion 22A includes an opening 25 that receives the button 24 that activates the circuitry 30. In one embodiment, the button 24 is recessed below a surface 22C of the housing 22 to avoid or at least minimize inadvertent activation of the circuitry 30 by an unintended depression of the button 24. As shown in FIG. 2, the activator 20 also includes the band 26 that may be secured about an appendage of a person such as, for example, the person's wrist or ankle. In one embodiment, a clip or clasp 28 secures the band 26 at a desired location. One embodiment of the upper portion 22A is illustrated in FIG. 3, and one embodiment of the lower portion 22B is illustrated in FIG. 4. As shown in FIG. 3, in one embodiment, it is within the scope of the present invention to provide one or more features 22D on the housing to assist in a functional operation of the activator 20 (e.g., finger grips) or to provide decorative or ornamental appearance to the activator 20 such as, for example, to add color or texturing to the surface 22C or the like. In one embodiment, illustrated in FIG. 4, the lower portion 22B of the housing 22 includes an aperture 22E for receiving the band 26. One embodiment of the band 26 is illustrated in FIG. 5, and one embodiment of the clip 28 is illustrated in FIG. 6.

Figure 7:
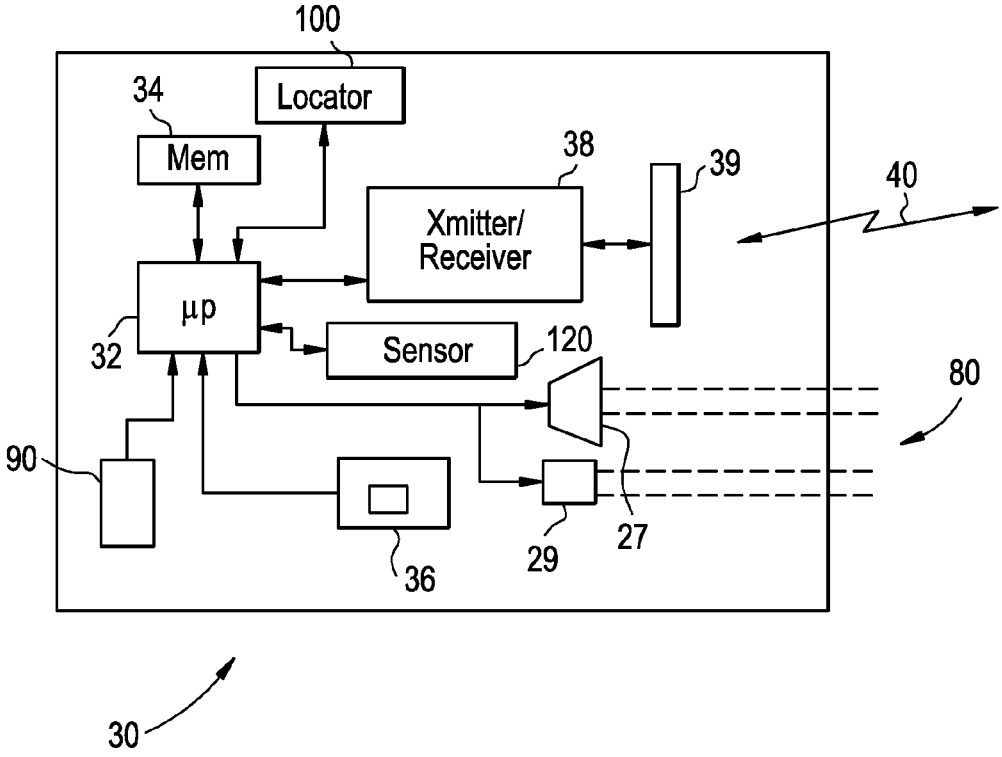
FIG. 7 is a schematic block diagram of circuitry of the activator and, by example, a base station of the life saving apparatus of FIG. 1, in accordance with one embodiment of the present invention.

FIG. 7 illustrates the circuitry 30 of the activator 20, in accordance with one embodiment of the present invention. As shown in FIG. 7, the circuitry 30 may include a processor 32 such as a microprocessor (MP), memory 34 that can include random access memory (RAM), read only memory (ROM), a hard drive (HD), and the like. As is generally known in the art, the memory 34 includes instructions executed by and/or values and parameters collected and processed by the processor 32 to accomplish the functions of the life saving apparatus 10. The circuitry 30 also includes a button activation module or contact 36, operatively coupled to the processor 32, to indicate that the switch or button 24 has been activated or depressed, and a transmitter/receiver 38 (e.g., transceiver), operatively coupled to the processor 32, for sending and receiving wireless communication signals such as, radio-frequency (RF), infrared (IR), and other electro-magnetic and/or optical signals 40, including a warning, alert or notification, as described herein, that the person is in distress. In one embodiment, the transmitter/receiver 38 is coupled to an antenna 39 to extend a range of transmission/reception of the activator 20. The circuitry 30 also includes a power source 90 such as, for example, a standard battery. As should be appreciated, the circuitry 30 is suitably sized to be positioned within the internal cavity 23 of the activator 20. In one embodiment, the circuitry 30 includes the speaker system 27 and/or lighting system 29 described above to provide the notification 80 (e.g., audio, visual, or a combination thereof) at the activator 20.

In one embodiment, the circuitry 30 also includes a locator device 100 capable of generating positional information of the activator 20 within the life saving apparatus 10. For example, the present system is configured to locate and track one or more activators 20 (and their embedded locator devices 100), in communication with the base station 60. In one embodiment, each locator device 100, and their respective activator 20, is assigned a unique identifier or serial number. As is known in the art, the locator device 100 may include and be operative with one or more radiolocation transmitters that comprise a global positioning system (GPS) that includes satellites and land-based radiolocation transmitters for locating the locator device 100 and the activator 20 relative to the base station 60, the life saving apparatus 10 and/or within a greater region monitored by, for example, persons of interest such as adults supervising one or more children or young adults in a given area, first responders or other emergency personnel. As is generally known in the art GPS satellites transmit signals having special codes containing information used by various receiving apparatus for calculating position. For example, the processor 32 includes algorithms operating thereon for determining the location of the locator device 100, as in known in the art, such as by calculating the distance between the locator device 100 and one or more GPS satellites using the timing signals provided by the GPS satellites, and carries out standard radiolocation calculations to formulate "positional data" which is the location of the locator device 100 relative to the positions of the one or more GPS satellites. The positional data formulated by the processor 32 may include latitude, longitude, and altitude information about the locator device 100. Such positional data being useful for locating the distressed person when that person is accompanied by a number of other persons.

While not shown, it should be appreciated that the circuitry 70 of the base station 60 includes similar components as that of the activator 20 such as, for example, a processor such as a microprocessor, memory that can include random access memory (RAM), read only memory (ROM), a hard drive (HD), and the like, and a transmitter/receiver (e.g., transceiver), operatively coupled to the microprocessor, for sending and receiving wireless communication signals such as, radio-frequency (RF), infrared (IR), and other electromagnetic and/or optical signals, including the warning, alert or notification, as described herein, from and to the activator 20. In one embodiment, the base station transmitter/receiver is coupled to an antenna to extend a range of transmission/reception between the base station 60 and the activator 20. The circuitry 70 also includes a power source 90 such as, for example, a standard battery 94 and/or an adapter 92 for coupling the base station 60 to line voltage from a house or other structure of interest. As should be appreciated, the circuitry 70 is suitably sized to be positioned within the housing 61 of the base station 60. In one embodiment, the circuitry 70 includes the speaker system 62 and/or lighting system 64 described above to provide the notification 80 at the base station 60.

It should be appreciated that while the circuitry 30 of the activator 20 is described as including the locator device 100 capable of generating positional information of the activator 20 within the life saving apparatus 10, it is within the scope of the present invention to deploy the GPS circuitry within the base station 60 and to use less costly locator devices or functionality within the one or more activators 20 in operative communication with the base station 60 to locate the activator 20 in proximity to the base station 60.

It should be appreciated that in one embodiment, the activator 20 includes a water resistant or relatively waterproof wrist band approximating a form factor of a wrist watch or other timing keeping device. In this embodiment, the circuitry 30 may include a time keeping element. As described above, the wrist watch includes a recessed button. When the button is pushed an alarm or notification message is generated to, for example, sound an alarm, indicating that the person wearing the wristwatch is in distress and requires immediate attention. In one embodiment, at least one of the activator 20 and/or base station 60 includes functionality such that the alarm or notification messages 80, as well as the positional information (if employed), is provided to one or more computing devices such as, for example, a workstation, laptop, notebook, tablet or other portable computing devices such as an iPad, smart phone, or the like. In this embodiment, the activator 20 and/or the base station 60 may include an electronic communication apparatus (e.g., modem or the like) to communicate over a network including, for example, a telephone network, a LAN, an intranet, or the Internet, using a selected communication protocol such as, for example, V.90 or V.32, or in the case of the Internet, TCP/IP.

In one embodiment, the base station 60 includes a water resistant or relatively water-proof housing. In one embodiment, the base station 60 may include a back up switch or push button such that if a person on shore sees someone in trouble (e.g., possibly drowning) the person can press the button on the base station 60 to generate the alarm or notification 80 so that the distressed swimmer can get attention.

In still another embodiment, as shown in FIG. 7, the circuitry 30 of the activator 20 may include a sensor 120, operatively coupled to the processor 32, for sensing and monitoring one or more physiological parameters including, for example, a pulse or heart rate, body temperature, and the like, of the person holding or wearing the life saving apparatus 10 to provide an automated response when the person is in duress and potentially unable to manually use the activator 20. For example, in one embodiment, the processor 32 and the sensor 120 cooperate to determine heart rate variability of the person over a plurality of events including, for example, rest, activity or motion (e.g., walking, running, swimming), and stress or duress, and establish one or more threshold values for the person individually or as compared to standard values of persons of like sex, age and/or fitness level. In a circumstance where one or more threshold values are exceeded, the processor 32 may determine that the person is not at rest, is not undertaking typical or normal activity or motion, but rather is under extreme stress or duress and thus activates the alarm or notification message 80 to direct attention to the person. Accordingly, in additional to providing a manual means for the person to use the activator 20 to signal or indicate to third parties that the person is in duress and requires assistance, the processor 32 and the sensor 120 cooperate to provide an additional automated response to a determined event of stress or duress. In one embodiment, the person may use the switch or button 24 to reset or deactivate the automated response or alarm condition.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above-detailed description. For example, the inventor recognizes that the life saving apparatus 10 may be used to:

(1) Aid young children going to and from school to stop possible abductors;

(2) Aid boy and girl scouts on hiking trips;

(3) Aid persons at work or home when someone needs help;

(4) Aid people getting their cars at night;

(5) Aid locating people trapped in buildings;

(6) Aid someone getting robbed or held up; and (7) Aid in the location of others in distress.

What is claimed is:

1. A life saving apparatus comprising:

(a) a plurality of activators, with one of each of the activators held or worn by a person performing an activity, each of the activators comprising:

(i) a housing comprising a button, a gripping member, and an internal chamber within the housing, with the top of the housing defining an opening, with at least a portion of the button recessed below the surface of the housing, with the gripping member essentially extending outwardly from at least a portion of the housing; and (ii) a first circuitry disposed within the chamber of the housing, the first circuitry comprising an activation means having a contact member, a first transmitting means, and a notification signal, with the contact member being operatively coupled to the first transmitting means, with the first transmitting means capable of transmitting and receiving the notification signal, and with the activation means selectively controlling the transmission of the notification signal; and (b) a base station operatively coupled to each of the plurality of activators for simultaneously and independently receiving and/or transmitting the notification signal to or from any one or more of the plurality of activators, the base station comprising a second circuitry disposed within the base station, with the second circuitry comprising a processor, the notification signal, and a second transmitting means in connectivity with the processor and the notification signal, with the base station processor capable of simultaneously and independently receiving and/or transmitting the notification signal to and/or from one or more of the activated plurality of activators, and with the processor activating the second transmitting means to generate an alert at the base station.

2. The life saving apparatus of claim 1, alert comprising an audio signal, a visual signal and/or a combination thereof.

3. The life saving apparatus of claim 2, the audio signal comprising a horn, a beep, or other audio transmission from a speaker system installed at the base station, installed within the circuitry of the base station, and/or installed within the circuitry of each activator.

4. The life saving apparatus of claim 2, the visual signal comprising a flashing or blinking light or other visual transmission from a lighting system installed at the base station, installed within the circuitry of the base station, and/or installed within the circuitry of each activator.

5. The life saving apparatus of claim 1, each of the plurality of activators further comprising a locator device operatively coupled to the first circuitry, with each locator device being capable of generating positional information of the activator.

6. The life saving apparatus of claim 1, each of the plurality of activators further comprising an adjustable band attachable to the housing wherein the housing further defines an aperture for attaching the band thereto.

7. The life saving apparatus of claim 1, the housing further comprising an upper portion and a lower portion, with the upper portion of the housing defining the opening that supports the button, and with the first circuitry being disposed within the lower portion of the housing.

8. The life saving apparatus of claim 1, the first transmitting means of each of the plurality of activators being selectively activated to generate and transmit the notification signal to the base station by the button being engageable upon the contact member to close a first circuit to the first transmitting means; or by the activating means further comprising a processor wherein the activator processor determines whether the engagement of the button upon the contact member exceeds a predetermined threshold before closing the first circuit to the first transmitting means; or upon the activator processor analyzing external data and physiological status of the person holding or wearing one of the activators before closing the first circuit to the first transmitting means.

9. The life saving apparatus of claim 1, the first circuitry of each of the plurality of activators further comprising at least one sensor for sensing the external data and physiological status of the person holding or wearing one of the activators, with the sensor being operatively coupled to the activating means to activate the first transmitting means to generate and transmit the notification signal to the base station.

10. The life saving apparatus of claim 8, the first circuitry further comprising an alert having an audible member and a speaker and/or a visual indicator, with the housing further defining a plurality of holes for the speaker and for the visual indicator, with the activation means further receiving a return notification signal from the base station wherein the return notification signal closes the circuit to generate and activate the alert for the activator.

11. A life saving apparatus comprising:

(a) a plurality of activators, with one of each of the activators held or worn by a person performing an activity, each of the activators comprising:

(i) a housing comprising a button, a gripping member, and an internal chamber within the housing, with the top of the housing defining an opening wherein at least a portion of the button recessed below the surface of the housing; and (ii) a first circuitry disposed within the chamber of the housing, the first circuitry comprising a locator device capable of generating positional information of the activator, an activation means having a contact member, a first transmitting means, and a notification signal, with the contact member being operatively coupled to the first transmitting means, with the first transmitting means capable of transmitting and receiving the notification signal, and with the activation means selectively controlling the transmission of the notification signal; and (b) a base station operatively coupled to each of the plurality of activators for simultaneously and independently receiving and/or transmitting the notification signal to and/or from any one or more of the plurality of activators, the base station comprising a second circuitry disposed within the base station, with the second circuitry comprising a processor, the notification signal, an alert, and a second transmitting means in connectivity with the processor and the notification signal, with the base station processor capable of simultaneously and independently receiving and/or transmitting the notification signal to and/or from one or more of the activated plurality of activators, with the processor activating the second transmitting means to generate the alert at the base station.

12. The life saving apparatus of claim 11, each of the plurality of activators further comprising an adjustable band attachable to the housing wherein the housing further defines an aperture for attaching the band thereto.

13. The life saving apparatus of claim 11, the housing further comprising an upper portion and a lower portion, with the upper portion of the housing defining the opening that supports the button, and with the chamber containing the circuitry disposed within the lower portion of the housing.

14. The life saving apparatus of claim 11, the first transmitting means of each of the plurality of activators being selectively activated to generate and transmit the notification signal to the base station by the button being engageable upon the contact member to close a first circuit to the first transmitting means; or by the activating means further comprising a processor wherein the activator processor determines whether the engagement of the button upon the contact member exceeds a predetermined threshold before closing the first circuit to the first transmitting means; or upon the activator processor analyzing external data and physiological status of the person holding or wearing one of the activators before closing the first circuit to the first transmitting means.

15. The life saving apparatus of claim 14, the first circuitry of each of the plurality of activators further comprising at least one sensor for collecting external data and physiological status of the person holding or wearing one of the activators, with the sensor being operatively coupled to the activating means to activate the first transmitting means to generate the notification signal to the base station.

16. The life saving apparatus of claim 14, the first circuitry further comprising a second alert having an audible member and a speaker and/or a visual indicator, with the housing further defining a plurality of holes for the speaker and for the visual indicator, with the activation means further receiving a return notification signal from the base station wherein the return notification signal closes the first circuit to generate and activate the second alert for the activator.

17. A life saving apparatus comprising:

(a) a plurality of activators, with one of each of the activators held or worn by a person performing an activity, each of the activators comprising:

(i) a housing comprising an upper portion and a lower portion, a button, a gripping member, an internal chamber within the housing, and an adjustable band attachable to the housing, with the housing further defining an aperture for attaching the band thereto, and with the upper portion of the housing defusing an opening wherein at least a portion of the button recessed below the surface of the housing; and (ii) a first circuitry disposed within the chamber of the lower portion of the housing, the first circuitry comprising an activation means having a contact member, a first transmitting means, and a notification signal, with the contact member being operatively coupled to the first transmitting means and the activation means, with the first transmitting means capable of transmitting and receiving the notification signal remotely or wirelessly to a base station and of generating a first alert for the activator, and with the activation means selectively controlling the transmission of the notification signal; and (b) a base station operatively coupled to each of the plurality of activators, the base station comprising a second circuitry disposed within the base station, the second circuitry comprising a processor, the notification signal, a second alert having an audible member and a speaker and/or a visual indicator, and a second transmitting means in connectivity with the processor and the notification signal, with the base station processor capable of simultaneously and independently receiving and/or transmitting the notification signal to and/or from one or more of the activated plurality of activators, with the base station processor activating the second transmitting means to generate second alert at the base station.

18. The life saving apparatus of claim 17, the first circuitry further comprising the first alert having an audible member and a speaker and/or a visual indicator, with the housing further defining a plurality of holes for the speaker and for the visual indicator, with the activation means further receiving a return notification signal from the base station wherein the return notification signal closes a first circuit to generate and activate the first alert for the activator.

19. The life saving apparatus of claim 17, the life saving apparatus further comprising a plurality of locator devices, with each of the locator devices operatively coupled to the first circuitry of a corresponding one of the plurality of activators, with the locator device capable of generating positional information about the location of the corresponding activator for transmission with the notification signal to the base station.

* * * * *